US005910086A

United States Patent [19]

Fisher

[11] Patent Number: 5,910,086

[45] Date of Patent: Jun. 8, 1999

[54] CONSTRUCTION BLOCK STRUCTURE

[76] Inventor: Myles Fisher, 2006 E. Mallory St., Pensacola, Fla. 32503

[21] Appl. No.: 08/613,544

[22] Filed: Mar. 11, 1996

[51] Int. Cl.[6] ..... E04B 5/46; E04C 1/42

[52] U.S. Cl. ..... 52/306; 52/307; 52/308; 52/586.1; 52/779; 52/780; 52/204.59

[58] Field of Search ..... 52/306–308, 586.1, 52/585.1, 779, 780, 588.1, 204.59, 204.71, 203

[56] References Cited

U.S. PATENT DOCUMENTS

| | | | |
|---|---|---|---|
| 4,793,104 | 12/1988 | Hultberg et al. | 52/306 X |
| 4,891,925 | 1/1990 | Carlson et al. | 52/585 |
| 4,986,048 | 1/1991 | McMarlin | 52/306 |
| 5,031,372 | 7/1991 | McCluer | 52/307 |
| 5,033,245 | 7/1991 | Kline | 52/306 |
| 5,038,542 | 8/1991 | Kline | 52/306 |
| 5,045,370 | 9/1991 | Roun | 52/204.59 X |
| 5,259,161 | 11/1993 | Carter | 52/307 |
| 5,261,205 | 11/1993 | Sandor | 52/284 X |
| 5,471,803 | 12/1995 | Logan et al. | 52/204.59 X |
| 5,595,033 | 1/1997 | Frey | 52/306 |

*Primary Examiner*—Carl D. Friedman
*Assistant Examiner*—W. Glenn Edwards
*Attorney, Agent, or Firm*—Peter Loffler

[57] ABSTRACT

A partition structure is comprised of a plurality of interconnected construction blocks. The partition structure can be formed in any size and shape including, triangular, rectangular, circular, semi-circular, trapezoidal, etc., by cutting away one or more outer edges of the structure. The partition structure can serve as the pane for a window or door frame.

29 Claims, 9 Drawing Sheets

FIG. 6
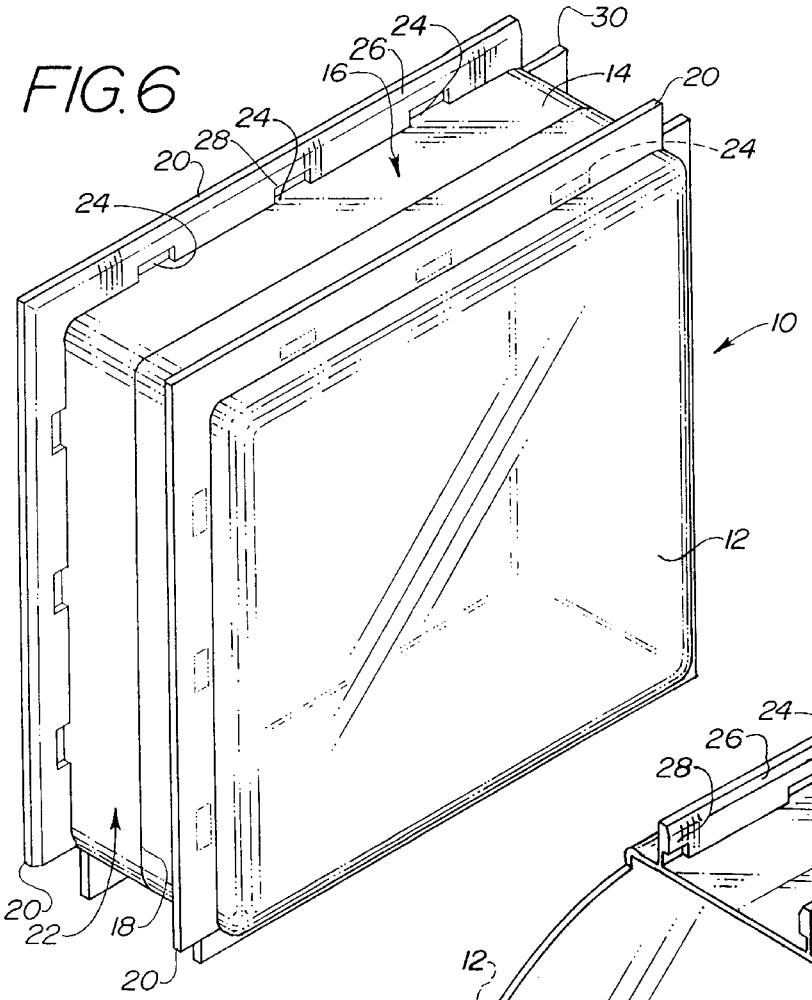
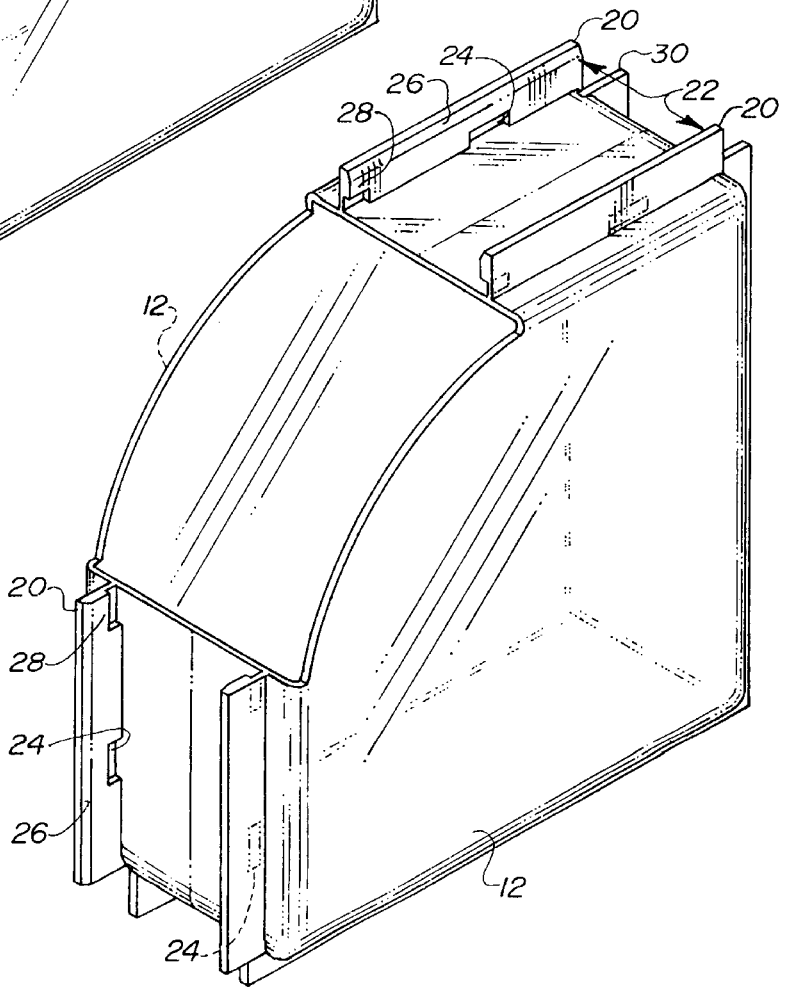
FIG. 10

CONSTRUCTION BLOCK STRUCTURE

BACKGROUND OF THE INVENTION

1. Field of the Invention

The present invention relates to partition structures and more specifically to windows and doors that have panes constructed from construction blocks.

2. Background of the Prior Art

Glass and glass-like partition walls are a regular part of modern construction. These structures can be fixed interior decorative walls, portable modular walls, or exterior wall structures. The partition structures are formed from a plurality of interconnecting construction blocks. These construction blocks, which are generally rectangular-shaped, are usually transparent or translucent and are formed from either glass or more often plastic. Such blocks can have a multitude of interconnection means.

Although exterior walls formed from construction blocks will tend to allow light to pass into the structure, such exterior walls are not considered windows in the proper sense. Even in buildings where the construction block-based exterior partition wall is designed to serve as a window, the window so formed is very limited in functionality. Such a window cannot be opened, nor can it be easily replaced. Furthermore, such a window must be constructed directly on the premises, usually by a skilled worker, increasing overall construction costs.

Therefore, there is a need in the art for a window that has a pane constructed from construction blocks. Such a window can be factory-made, off of the building construction premises. Such a window can be made to function as any other type of window. Specifically, such a window, which should be of any given size, shape, and design, can be either fixed or movable. A movable window may be a sliding-type window that can slide up and down or left and right. Alternately, the window may be able to serve in a hinged-base window system.

Such a window will increase the aesthetic appeal of a building utilizing the window. The window will have substantially more versatility than a standard construction block-based partition wall, at considerable cost savings due to off-site assembly and frame fabrication.

Ideally, construction block-based doors should also be provided.

SUMMARY OF THE INVENTION

The construction block-based partition structure of the present invention meets the aforementioned needs in the art. The partition structure of the present invention provides for a window that has a construction block-based structure which serves as the window's pane. The window will function and serve as any other standard window. A construction block-based door can be designed in a similar fashion.

Specifically, the construction block-based partition structure is comprised of a frame, either door or window, and a pane located therein. The frame can be made from wood, vinyl, aluminum, or any other suitable frame material. The pane is constructed of a plurality of construction blocks interconnected in appropriate fashion.

The partition structure of the present invention can be constructed in polygonal shapes such as triangular, hexagonal, octagonal, dodecahedronal, and many others. The partition structures can have outer edges that are non-parallel to the opposing outer edges. Curved outer edges, or entirely circular-shaped structures are also possible with the partition structure of the present invention. In order to achieve the non-rectangular shape of the construction block-based partition structure, the construction blocks are interconnected in the usual way forming the typical rectangular-shaped partition structure. Thereafter, one or more of the outer edges of the partition structure are cut away so that the resulting partition structure is of the desired shape, having radius' or angles with no geometric limitation.

In order to readily achieve the non-rectangular-shaped partition structure of the present invention that comprises the pane of the door or window, it is desired that the construction block interconnections be able to withstand partial block removal. Cuts must be made across two or more blocks and the interconnection means between the cut blocks must not fail. The resulting partition structure must have similar structural integrity to its rectangular-shaped counterparts.

In order to achieve such successful partial block removal, the construction blocks should have interconnection means located along the lengths of their outer edges. Edge-based interconnection means are in contrast to, and preferred over, corner-based interconnection means. An example of the latter interconnection means can be found in U.S. Pat. No. 4,891,925 issued to Carlson. By having edge-based interconnection means, partial block removal will result in the remainder of one block being substantially connected to the remainder of another block to which the first block is connected. Such substantial connection facilitates the building of awkward-shaped partition structures. For example, a circular window may be cut such that only a small portion of a given construction block remains. Through edge-based block interconnection, this small portion will remain intact with the overall partition structure.

Partial block removal of a corner-based interconnection means block is limiting and results in substantial interconnection means removal which can result in block interconnection failure. Such limitations reduce the possible shapes of construction block-based partition structures that can be constructed.

An example of a block that meets the above-stated interconnection needs is disclosed.

BRIEF DESCRIPTION OF THE DRAWINGS

FIG. 6 is an isometric view of the construction block, utilizable with the partition structure of the present invention, showing the outer spacing flanges.

FIG. 10 is an isometric view of the construction block of FIG. 6 with a section of the block removed.

Similar reference numerals refer to similar parts throughout the several views of the drawings.

DETAILED DESCRIPTION OF THE PREFERRED EMBODIMENT

Figure 1B:
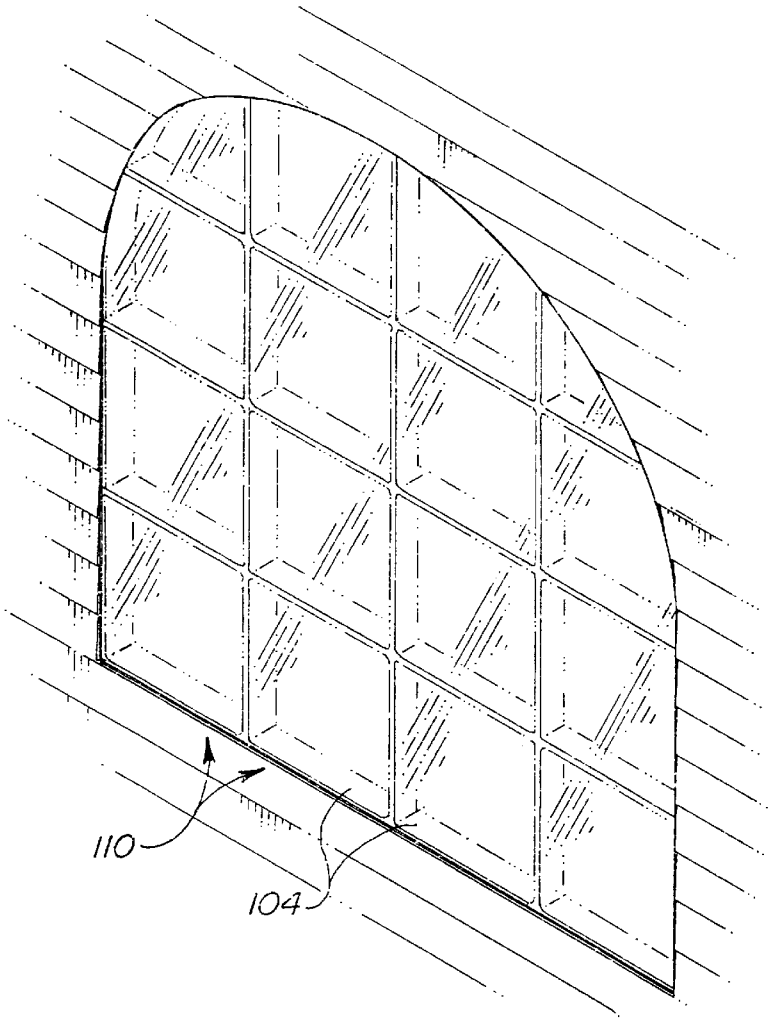
FIG. 1B is an isometric view of the construction block partition structure disposed with a wall of a building.
Figure 1A:
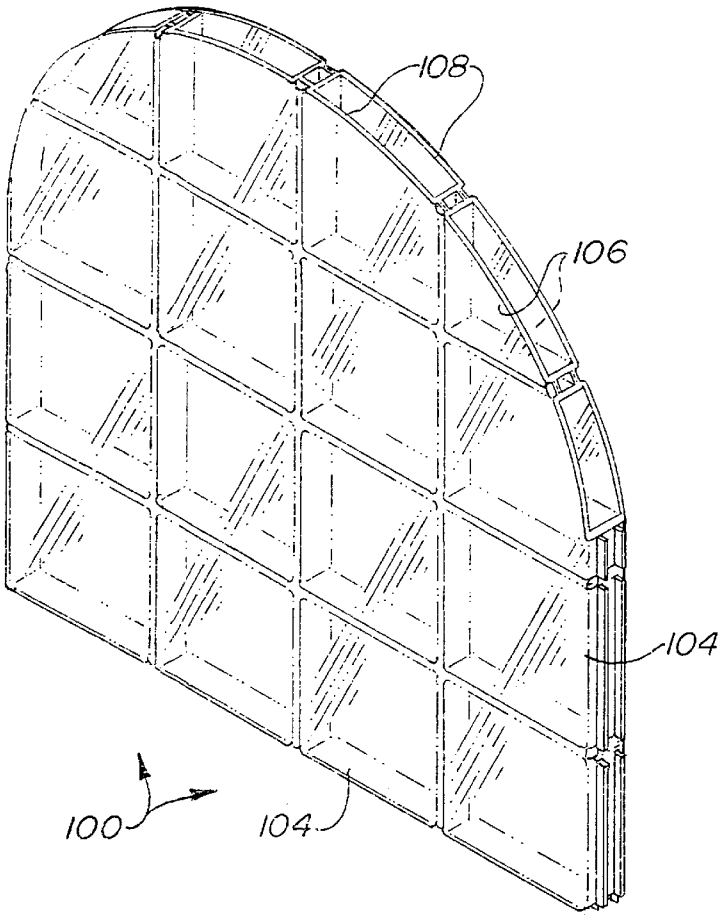
FIG. 1A is an isometric view of the construction block partition structure of the present invention.
Figure 2B:
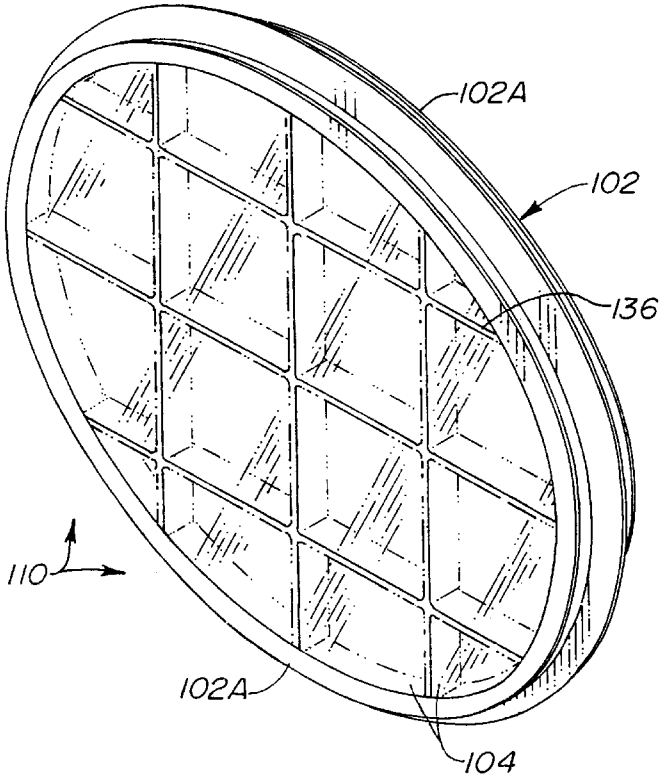
FIG. 2B is an isometric view a of circular window frame-based embodiment of the construction block partition structure.
Figure 2A:
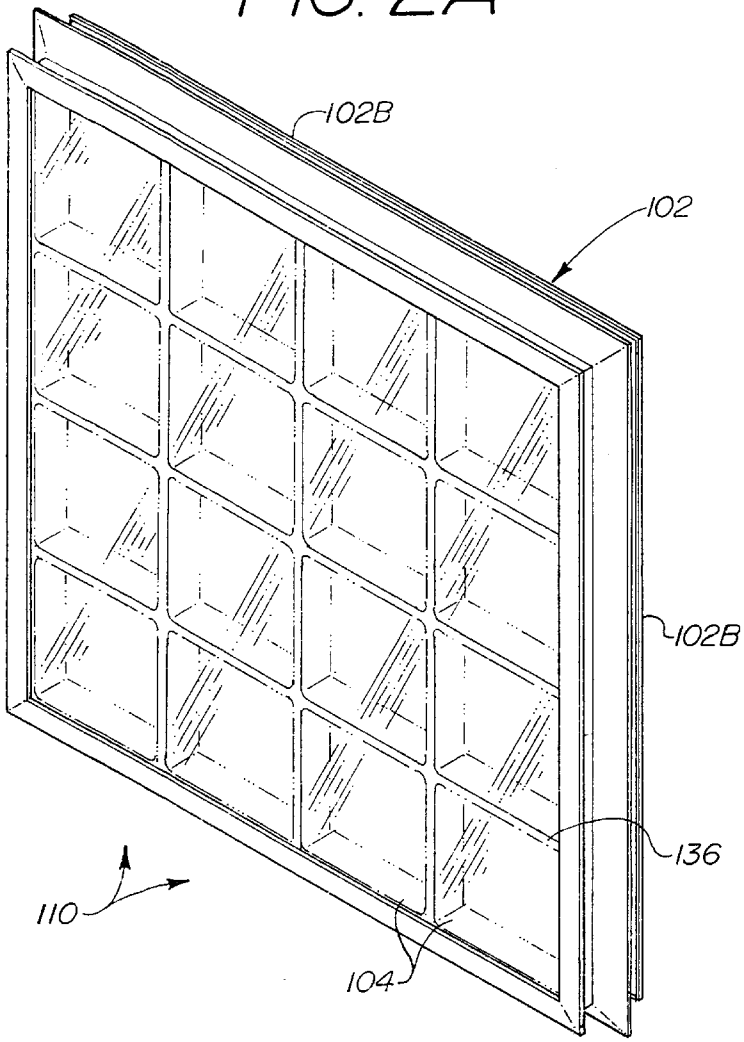
FIG. 2A is an isometric view of a rectangular window frame-based embodiment of the construction block partition structure.

Referring now to the drawings, it is seen that the construction block partition structure of the present invention is generally denoted by reference numeral 100. The structure 100 is comprised of a frame member 102 having a pane 104 disposed therein. The frame 102 can be either a door frame or a window frame, as desired. The frame 102 can be fabricated from wood, vinyl, aluminum, or any other suitable frame material. The pane 104 is comprised of a plurality of construction blocks 10 interconnected to one another. The construction blocks 10 can be of any appropriate type including blocks 10 that are made from either glass or plastic and blocks 10 that are either transparent, translucent, or opaque. The structure 100 has a pair of opposing faces 106 and one or more outer edges 108.

The frame 102 and the resulting pane 104 can be of any appropriate shape including triangular, rectangular, pentagonal, hexagonal, octagonal, decagonal, dodecahedronal, trapezoidal, circular, semi-circular, column-arch, as well as any other shape. A structure 100 is formed by interconnecting a plurality of construction blocks 10 in usual fashion. Structural bars 40, either concealed or visible, can be inserted between rows of interconnected blocks, if desired. Thereafter, one or more outer edges 108 of the formed structure 100 are cut away so that the resulting structure can fit snugly within the constructed frame 102. once fitted within the frame 102, the structure 100 is siliconed or otherwise secured within the interior of the frame 102.

In order to achieve the non-rectangular shape of the partition structure 100 of the present invention, a rectangular-shaped partition structure is initially formed. Thereafter, one or more outer edges of the resulting rectangular-shaped partition structure is cut away in order to achieve the desired shape. The resulting non-rectangular-shaped partition structure 100 can be utilized with a frame 102, either a door or window frame, or independent of the frame 102 as a partition wall having a non-standard shape.

In order to successfully cut away part of the rectangular-shaped partition structure, it is desired that the construction block interconnections be able to withstand this partial block removal. Cuts must be made across two or more blocks and the interconnection means between these blocks must not fail. The resulting partition structure must have similar structural integrity to its rectangular-shaped counterpart.

In order to achieve such successful partial block removal, the construction blocks should have interconnection means located along the lengths of their outer edges. Edge-based interconnection means are in contrast to, and preferred over, corner-based interconnection means. By having edge-based interconnection means, partial block removal will result in the remainder of the block being substantially connected to the remainder of the other block to which the first block is connected. Partial block removal of a corner-based interconnection means block results in substantial interconnection means removal, which can result in block inte rco nnection failure.

FIGS. 6–13, provide an example of a construction block 10 that facilitates fabrication of the partition structure of the present invention. As seen, such a construction block 10 is comprised of a generally rectangular form, having a pair of parallel disposed faces 12 joined by four side edges 14. The block 10 may be formed as a single unit, or as shown, as a pair of identical halves 16 joined along seam 18 in any appropriate fashion.

Located on two of the side edges 14 are a pair of outer 16 spacing flanges 20 extending perpendicularly outward from the plane of the side edge 14 adjacent and parallel to each face 12. A recess 22 exists between the outer sp acing flanges 20. The two side edges 14 that contain the outer spacing flanges 20 can be adjacent side edges 14 or opposing side edges 14. As seen in FIG. 6, one or more hook receptacles 24 are located along the length of each outer spacing flange 20. As seen, the hook receptacle 24 has a ramped portion 26 and a lip 28.

Located on two of the side edges 14 are a pair of inner spacing flanges 30 extending perpendicularly outward from the plane of the side edge 14 adjacent and parallel to each face 12. A recess 32 exists between the inner spacing flanges 30. The two side edges 14 that have the inner spacing flanges 30 can be adjacent side edges 14, if adjacent side edges 14 hold the outer spacing flanges, or opposing side edges 14, if opposing side edges 14 hold the outer spacing flanges 20. One or more hooks 34, in corresponding number to the number of hook receptacles 24 that are located on the outer spacing flanges 20 and in corresponding locations along the length of the side edges 14 relative to the locations of the hook receptacles 24, are located along the length of each inner spacing flange 30. As seen, each hook 34 has a ramped portion 36 and a lip 38. A small void area 40 separates the hooks 34 from the inner spacing flanges 30. The height of the outer spacing flanges 20, inner spacing flanges 30, and hooks 34 are all equal. The inner spacing flanges 30 are positioned closer to the central portion of their respective side edges 14 relative to the outer spacing flanges 20.

In order to interconnect two blocks 10 to one another, the blocks 10 are positioned such that a side edge 14 having inner spacing flanges 30 of one of the blocks 10, faces a side edge 14 having outer spacing flanges 20 of the other block 10. The two blocks 10 are pushed toward one another. This causes the ramped portion 36 of each hook 34 to interact with the ramped portion 26 of the corresponding hook receptacle 24. The hook 34 is formed such that it is sufficiently resilient to bend inwardly to permit the two ramped portions 26 and 36 to pass over one another. Once the ramped portions 26 and 36 pass one another, the hook 34 "clicks" into place and returns to its original position. As such, the lip 38 of the hook 34 abuts the lip 28 of the hook receptacle 24. The two lips 28 and 38 hold one another and prevent the blocks 10 from being separated from each other. The blocks 10 can separated from each other only by permanent invalidation of one of the blocks.

In this position, the tops of outer spacing flanges 20 of the first block 10 abut the side edge of the second block 10 while the tops of the inner spacing flanges 30 and hooks 34 of the second block 10 abut the side edge of the first block 10. This results in a secure and tight fit of the two blocks to each other. If desired, a structural bar 40 can be positioned within the inner spacing flange recess 32 between the blocks after interconnecting the blocks 10 resulting in an even tighter and more secure interfit.

The outer faces of the outer flanges 20 form a continuous grout groove. Once two blocks 10 are interconnected, the overlap of each outer spacing flange 20 with its corresponding inner flange 30 can be ultrasonically welded or otherwise fastened to further secure adjacent blocks 10 to each other.

The use of this type of construction block 10 assures a partition structure 100 that maintains structural integrity after a section of the structure 100 is cut away. By using edge-based interconnection means, partial block removal will result in the remainder of the block being substantially connected to the remainder of the other block to which the first block is connected. Therefore, the two partially cut blocks will remain tightly interconnected to one another. Furthermore, by using overlapping outer and inner flanges, ultrasonic welding or fastening of two blocks to one another can be achieved. This results in enhanced block interconnection and in enhanced structural integrity of the overall structure. This also permits partition structures having dimensions that are not an integer multiple of the lengths or widths of the individual construction blocks 10.

It is expressly recognized that the description of the above construction block 10 is provided by way of example only and that other types of blocks 10 may be utilized in practicing the present invention.

Figure 5A:
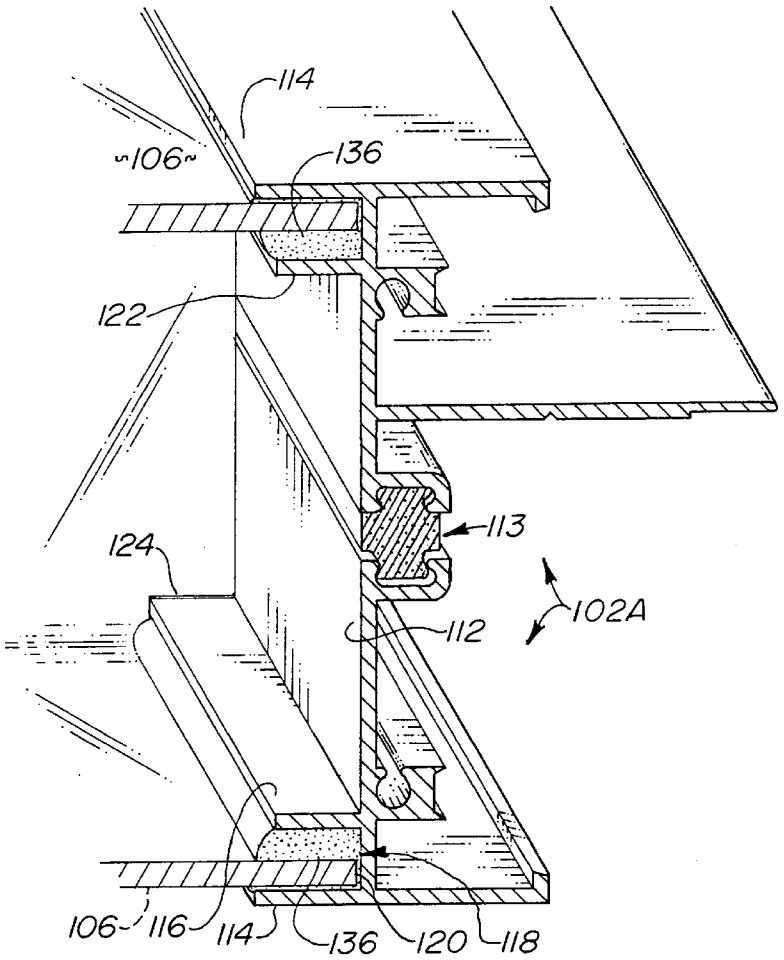
FIG. 5A is a cutaway view of the first type of frame that will receive a cutaway construction block.
Figure 4:
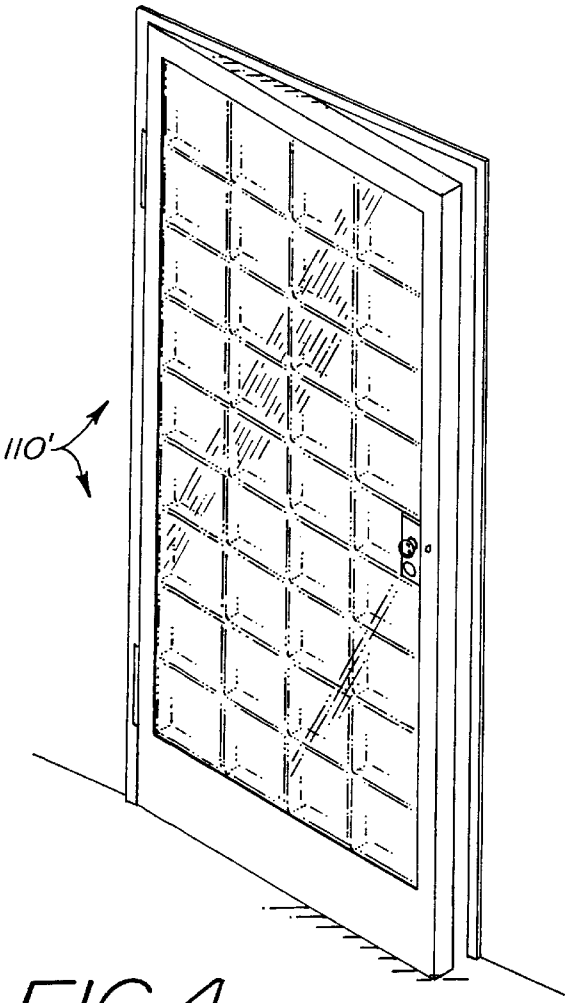
FIG. 4 is an isometric view of a door frame-based embodiment of the construction block partition structure.

FIG. 5A illustrates a cutaway portion of a first frame section 102A used to construct a construction block-based partition window 110 or door 110' of the present invention. This frame 102A receives an outer edge 108 of the partition structure 100, which outer edge 108 has had a section of block 10 removed therefrom. As seen, this frame section 102A is comprised of a base 112 having a pair of outer flanges 114 and a first pair of inner flanges 116 disposed parallel to the outer flanges 114, forming a first channel 118. A thermal break 113 may extend the length of the base. The first channel 118 receives the cut edge 120 of the face 12 of one or more construction blocks 10. The first channel 118 must be of sufficient width to account for variations in face patterns. Various face patterns will have various cutaway edge 120 thicknesses. The side edges 14 of the blocks 10 must be notched 124 so that the first pair of inner flanges 116 are received within the notches 124 when the block 10 is fitted into the frame. The side edge 14 is notched 124 at the area of the cut performed on the block, near the structural flange, either outer 20 or inner 30 of the block 10. The first channel 120 serves as the recipient location for silicone 136 used to seal the structure 100 to the frame 102A.

Figure 5C:
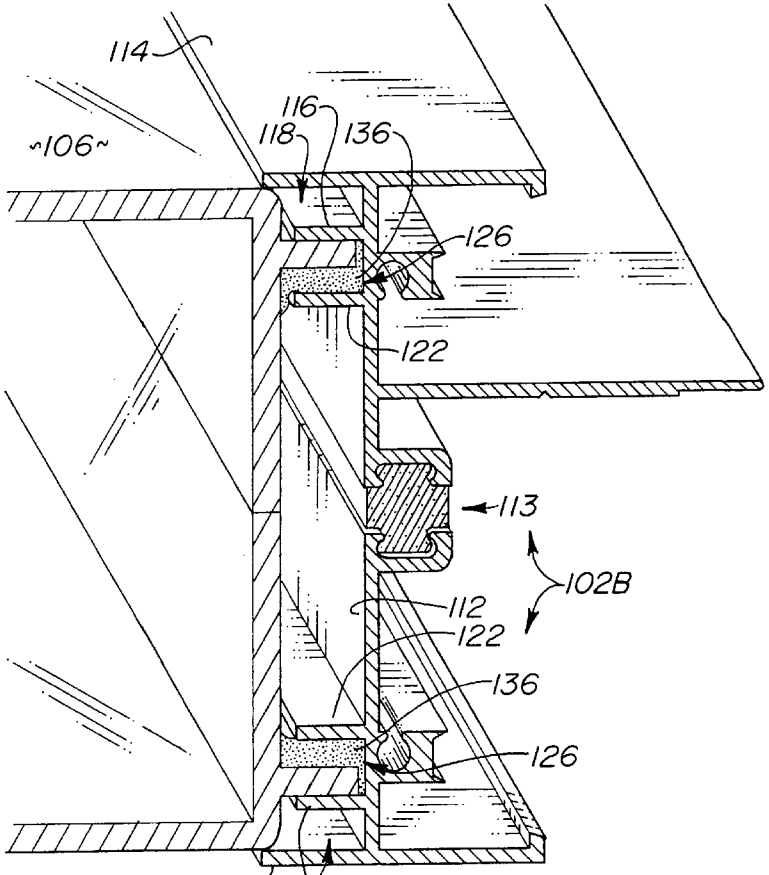
FIG. 5C is a cutaway view of the second type of frame receiving an inner flange of a natural edge of a construction block.
Figure 5B:
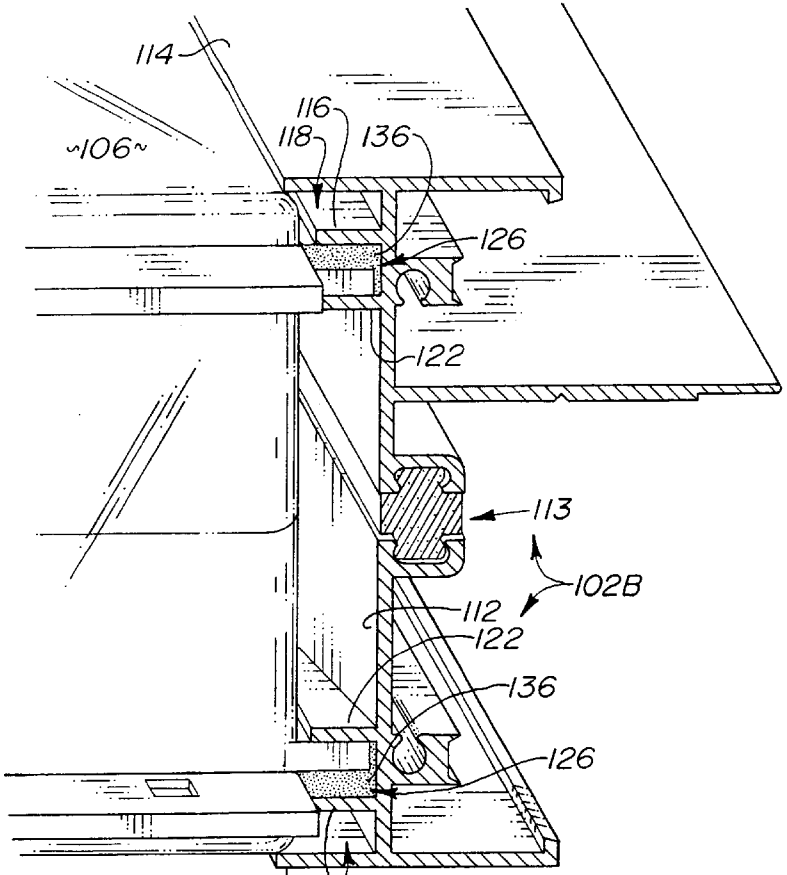
FIG. 5B is a cutaway view of the second type of frame receiving an outer flange of a natural edge of a construction block.
Figure 7:
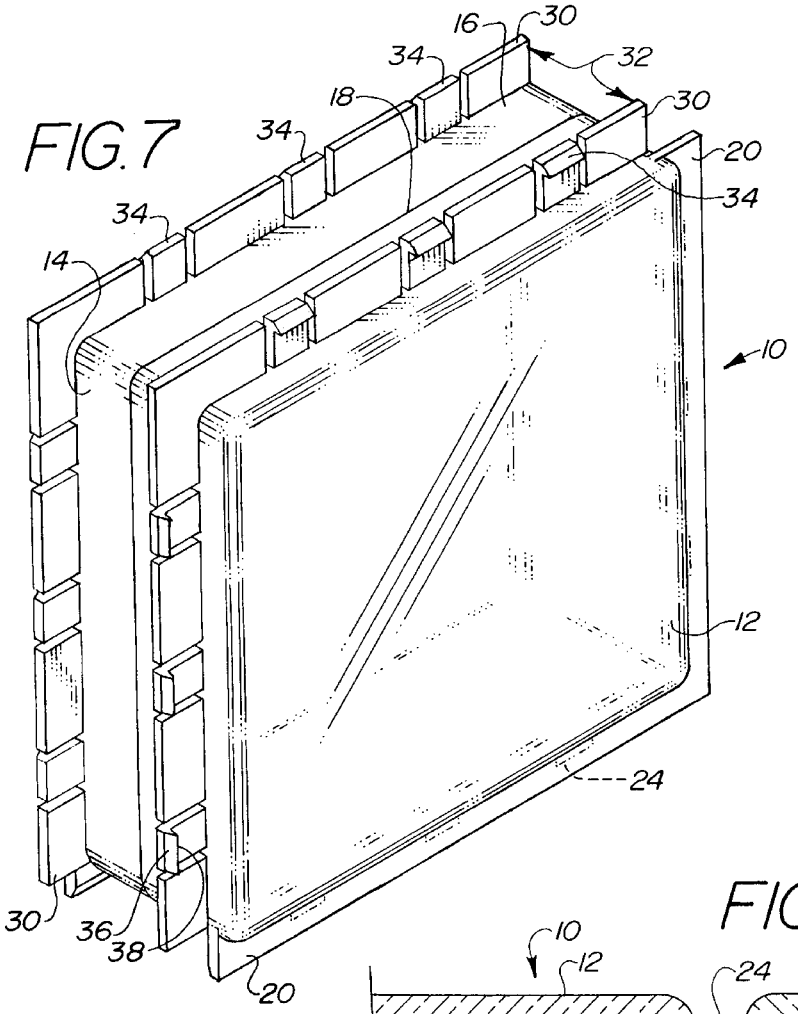
FIG. 7 is a rotated isometric view of the construction block of FIG. 6 showing the inner spacing flanges.
Figure 13:
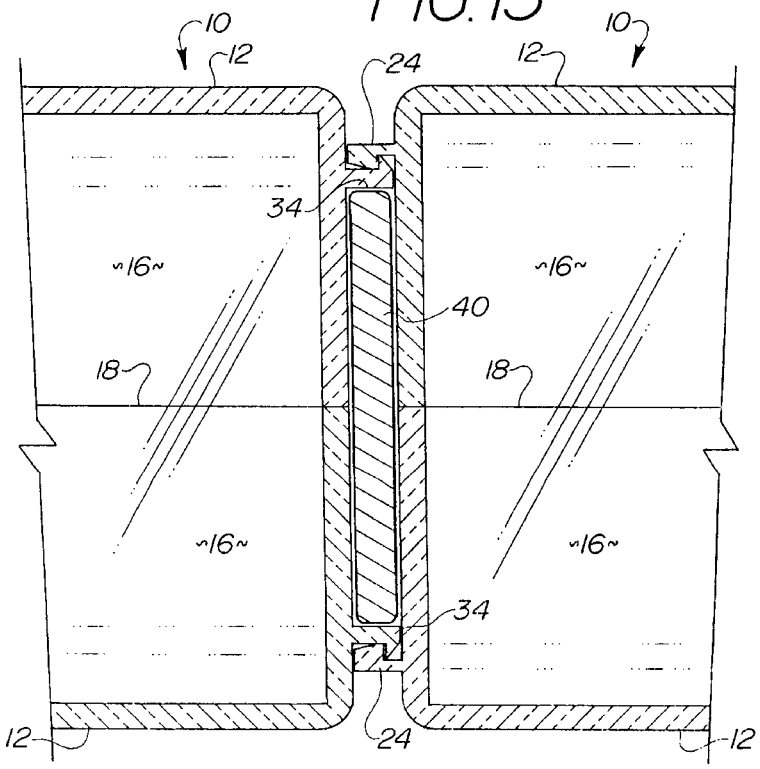
FIGS. 11–13 are cutaway views illustrating interconnection of two construction blocks of FIG. 6.
Figure 8:
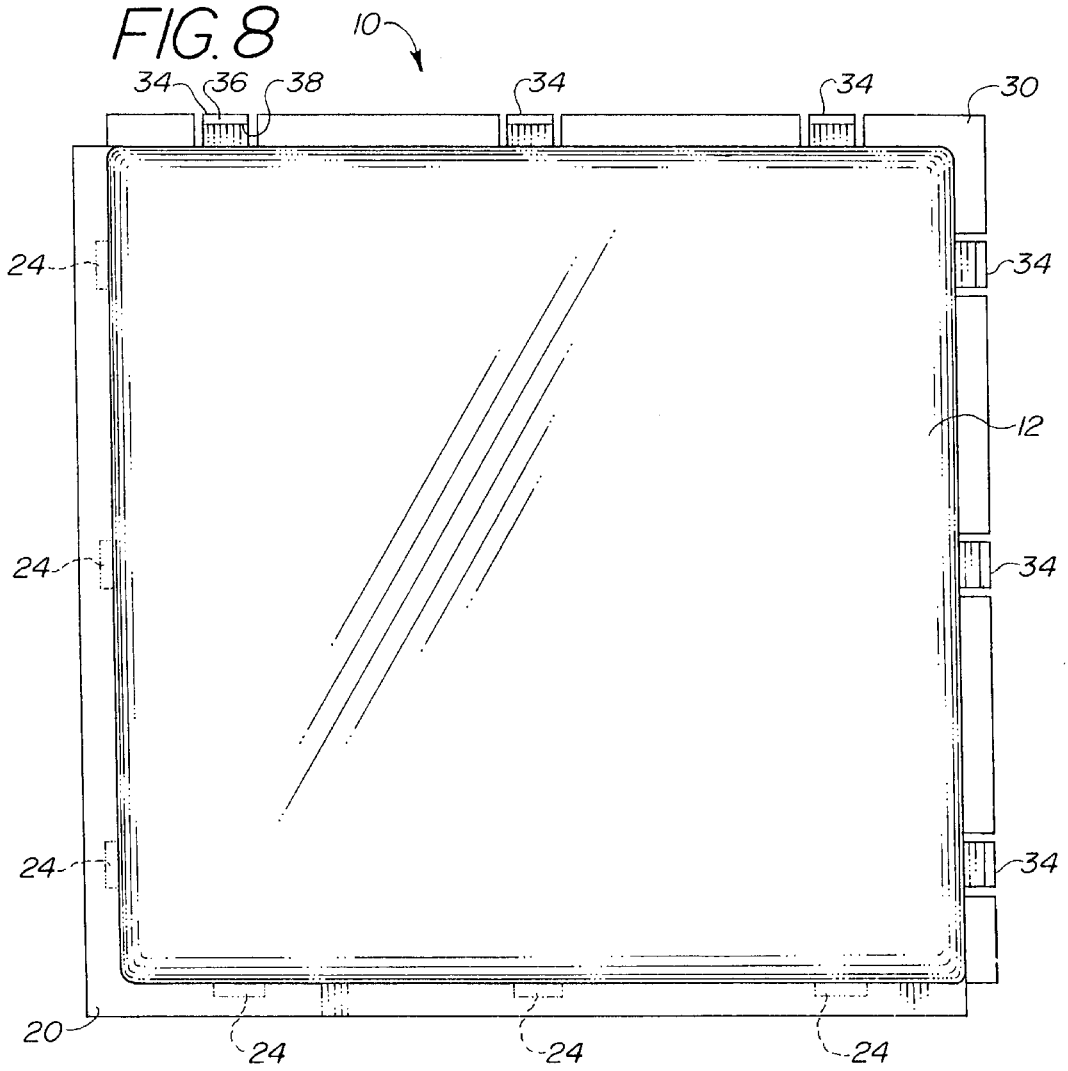
FIG. 8 is a front elevation view of the construction block of FIG. 6.
Figure 9:
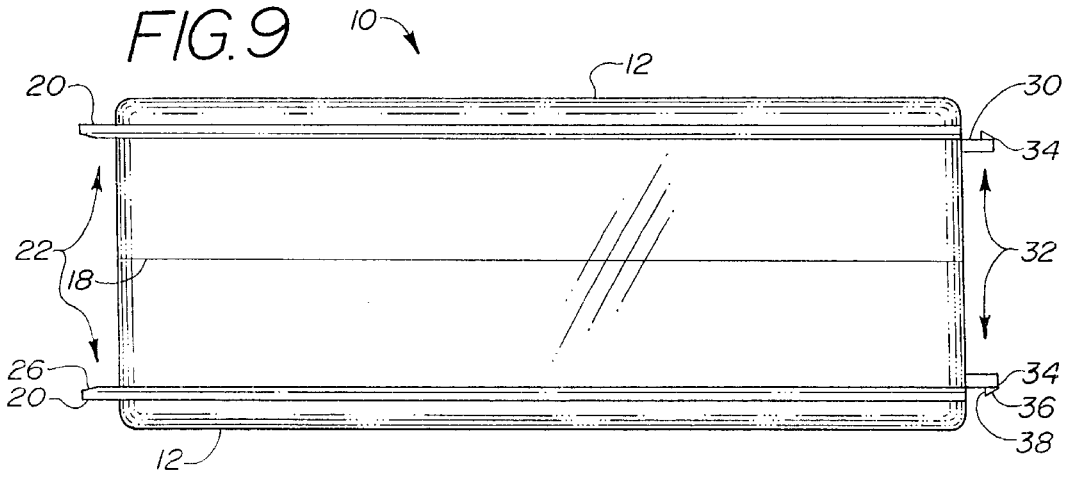
FIG. 9 is a top plan view of the construction block of FIG. 6.
Figure 11:
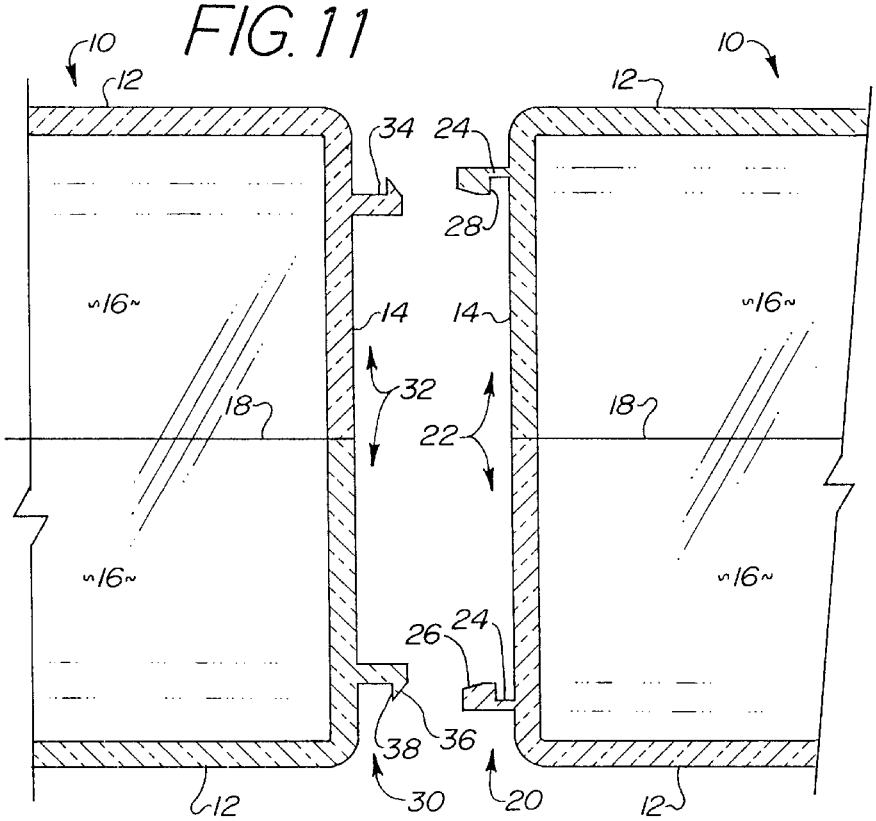
Figure 12:
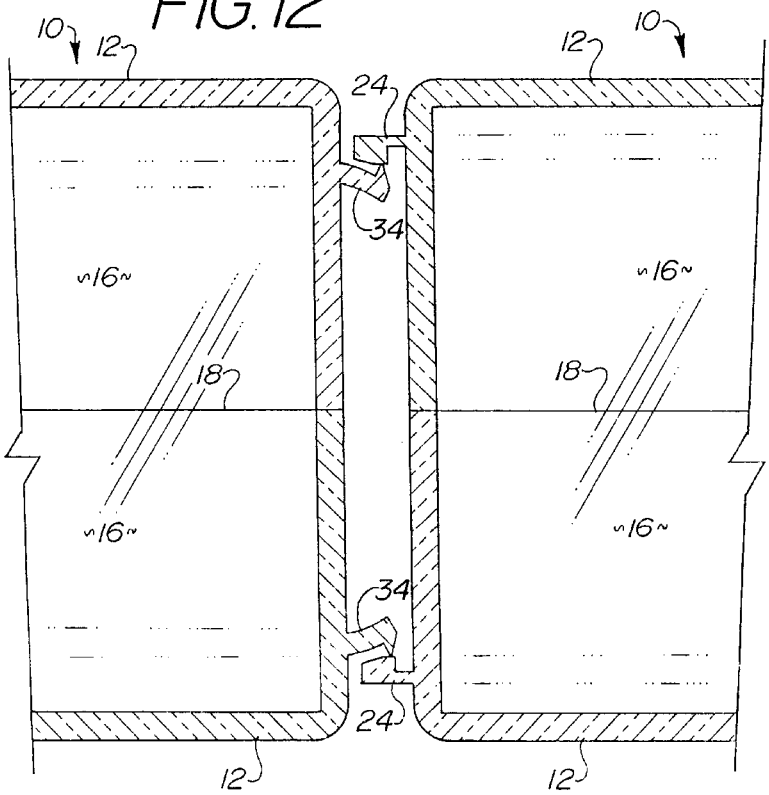

FIGS. 5B and 5C illustrates a cutaway portion of a second frame section 102B used to construct a partition block-based window 110 or door 1101 of the present invention. This frame section 102B receives the natural side edge 14 of the partition structure 100, which edge 14 has not had a section of block removed therefrom. As seen, this frame section 102B is comprised of a base 112 having a pair of outer flanges 114, and a first pair of inner flanges 116 are disposed parallel to the outer flanges 114, forming a first channel 118. A second pair of inner flanges 122 are disposed parallel to the first pair of inner flanges 116. The first pair of inner flanges 116 and the second pair of inner flanges 122 form a second channel 126. This second channel 126 receives the pre-molded block structural flanges, either inner 30 or outer 20, of the construction block 10. At the corner of the interconnection of two construction blocks 10, the inner flange 30 of one block 10 overlaps the outer flange 20 of the other block 10. The second channel 126 must be of sufficient width to accommodate these overlapped flanges. The second channel 126 serves as the recipient location for silicone 136 to seal the construction block spacing flanges to the frame 102B.

Figure 3:
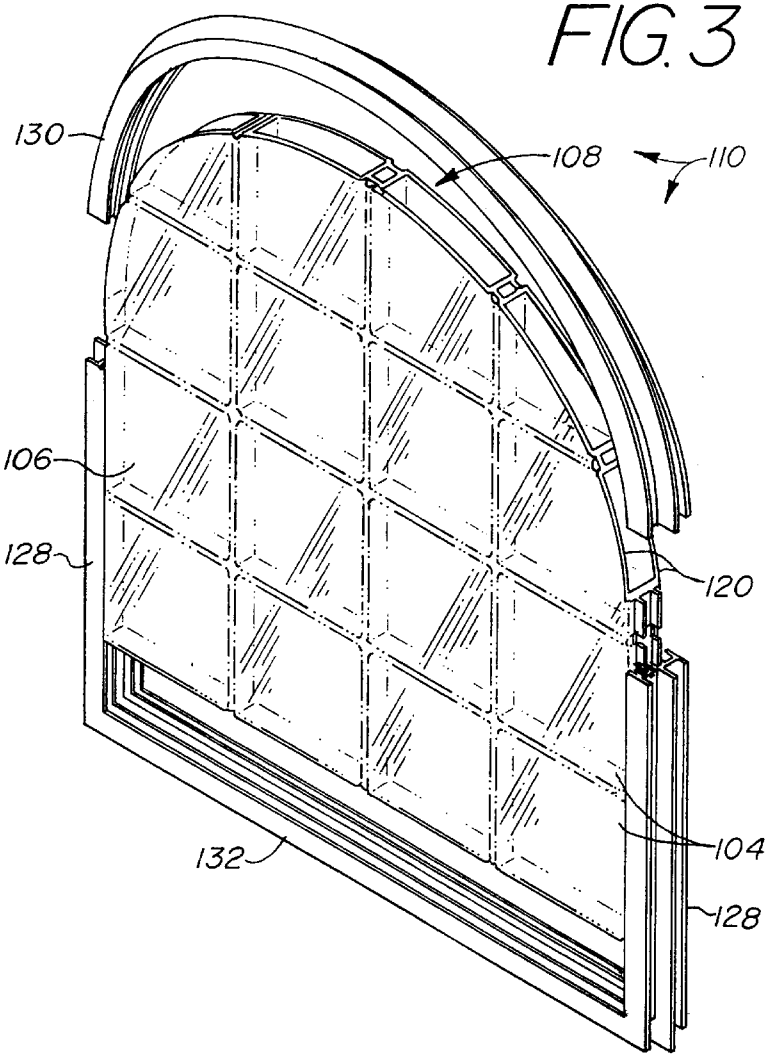
FIG. 3 is an exploded view of FIG. 2C.
Figure 2C:
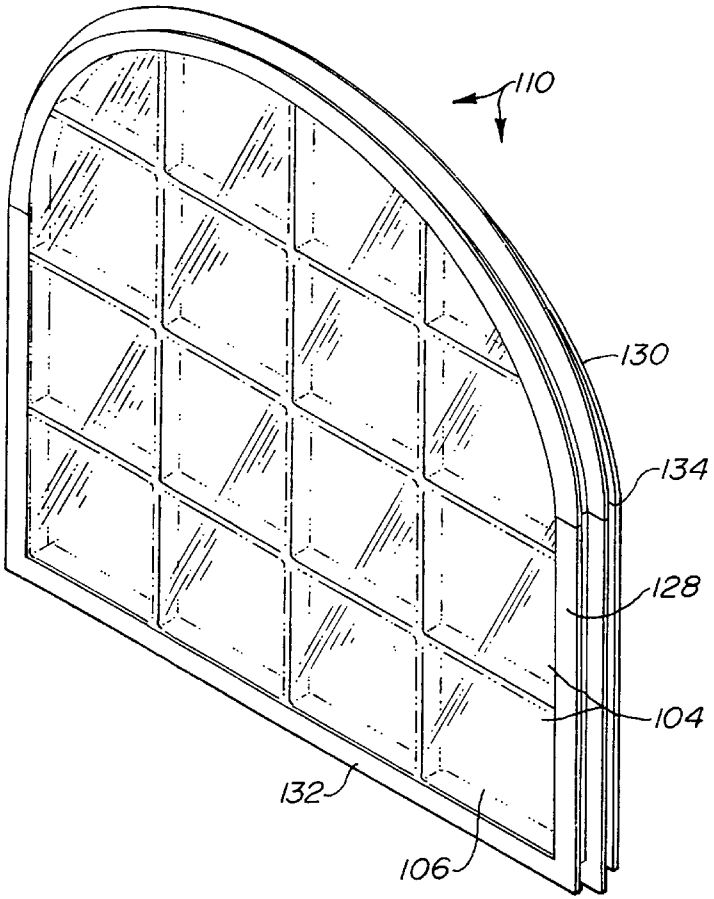
FIG. 2C is an isometric view a column arch frame-based embodiment of the construction block partition structure.

FIGS. 2C and 3 illustrate the construction of a column-arched window 110. A pair of straight leg portions 128 and a radius top 130 are provided. The ends of a sill 132 are mitered and mechanically fastened or welded to the bottoms of each leg 128. A plurality of construction blocks 10 are interconnected to form a generally rectangular-shaped partition structure. If desired, one or more concealed or visible structural bars 40 are positioned between either rows or columns of the interconnected blocks 10. If desired, the overlapped flanges (if overlapped flange-type construction blocks are utilized) may be welded or fastened to one another. The top of the structure is cut away so that the shape of the top of the structure corresponds to the shape of the radius 130 section of frame 102. If required, one of the sides of the partition structure 100 is cut away so that the structure fits between the two frame legs 128 permitting structure size flexibility. Edge-based block interconnection permits this cutting away without losing overall partition structural integrity.

The radius frame section 130 is of the first frame type 102A while the sill and at least one of the legs 128 is of the second frame type 102B. If the side of the partition structure 100 is cut, then the second leg 128 is of the first frame type 102A, otherwise the second leg 128 is of the second frame type 102B. The side edges 14 of each block 10 located along the outer edges 108 of the structure 100 that has been cut away, are notched 124 so that the first flange of the respective frame member can be received within the notch 124. The prepared partition structure 100 is positioned within the legs 128 and sill 132. The radius 130 is mechanically fastened or welded to the tops of the legs 128 by the use of butt joints 134. If desired, the partition structure is siliconed into place within the frame 102.

The block window 110 or door 110' is now ready for installation within a building. The block window 110, having any shape and dimensions, may be a fixed window, a sliding (either horizontally or vertically sliding) window, or a hinged window. The door 110' may be a hinged door, a swinging door, or a sliding door.

It is expressly recognized that windows of any desirable shape and size can be constructed in similar fashion. The construction block partition of the present invention is an ideal platform for circular windows.

While the invention has been particularly shown and described with reference to an embodiment thereof, it will be understood by those skilled in the art that various changes in form and detail may be made without departing from the spirit and scope of the invention.

I claim:

1. A non-rectangular-shaped partition structure comprising:

a pane having a pair of facades and at least one outer boundary and comprising a plurality of construction blocks, each of the plurality of construction blocks having a pair of faces joined by a first side edge, a second side edge, a third side edge, and a fourth edge, each of the plurality of construction blocks directly connected, at one of this construction block's edges, to at least one other of the plurality of construction blocks, at one of this construction block's edges a pair of outer spacing flanges extending about the first side edge and the second side edge adjacent and essentially parallel to the faces at least one hook receptacle located along the outer spacing flanges and facing one of the pair of faces, a pair of inner spacing flanges extending about the third side edge and the fourth side edge adjacent and essentially parallel to the faces, and at least one hook, in corresponding number to the number of hook receptacles located along the inner spacing flanges and facing one of the pair of faces each of the at least one hook adapted to be received within a corresponding hook receptacle of the at least one hook receptacle, when one of the plurality of construction blocks is interconnected with another of the plurality of construction blocks; and wherein at least one of the plurality of construction blocks has a portion removed, with the boundary at the line of removal defining at least in part, the outer boundary, in order to make up the structure.

2. The structure as in claim 1 further comprising:

at least one structural bar positioned between the inner spacing flanges between interconnected construction blocks.

3. The structure as in claim 1 wherein the construction block is formed from translucent plastic.

4. The structure as in claim 1 wherein the construction block is formed from transparent plastic.

5. The structure as in claim 1 wherein each of the at least one hook receptacle has a one way ramp.

6. The structure as in claim 1 wherein each of the at least one hook has a one way ramp.

7. The structure as in claim 1 wherein each of the at least one hook receptacle has a one way ramp and each of the or more hooks at least one hook has a one way ramp.

8. The structure as in claim 1 wherein the first side edge is adjacent to the second side edge.

9. The structure as in claim 1 wherein the first side edge is adjacent to the third side edge.

10. The structure as in claim 1 further comprising:

a pair of outer spacing flanges extending about the first side edge and the second side edge adjacent and essentially parallel to the faces;

at least one hook receptacle located along the outer spacing flanges and facing one of the pair of faces;

a pair of inner spacing flanges extending about the third side edge and the fourth side edge adjacent and essentially parallel to the faces; and at least one hook, in corresponding number to the number of hook receptacles, located along the inner spacing flanges and facing one of the pair of faces each of the at least one hook adapted to be received within a corresponding hook receptacle of the at least one hook receptacle, when one of the plurality of construction blocks is interconnected with another of the plurality of construction blocks.

11. The structure as in claim 10 further comprising:

at least one structural bar positioned between the inner spacing flanges between interconnected construction blocks.

12. The device as in claim 10 wherein the construction block is formed from translucent plastic.

13. The device as in claim 10 wherein the construction block is formed from transparent plastic.

14. The structure as in claim 10 wherein each of the at least one hook receptacle has a one way ramp.

15. The structure as in claim 10 wherein each of the at least one hook has a one way ramp.

16. The structure as in claim 10 wherein each of the at least one hook receptacle has a one way ramp and each of the at least one hook has a one way ramp.

17. The structure as in claim 10 wherein the first side edge is adjacent to the second side edge.

18. The structure as in claim 10 wherein the first side edge is adjacent to the third side edge.

19. The structure as in claim 10 wherein each of the outer spacing flanges is ultrasonically welded or fastened to the inner spacing flange that the outer spacing flange overlaps.

20. A partition structure comprising:

a frame;

a pane having a pair of facades and at least one outer boundary and comprising a plurality of construction blocks, each of the plurality of construction blocks having a pair of faces joined by a first side edge, a second side edge, a third side edge, and a fourth edge, each of the plurality of construction blocks directly connected, at one of this construction block's edges, to at least one other of the plurality of construction blocks, at one of this construction block's edges; and wherein at least one of the plurality of construction blocks has a portion removed, with the boundary at the line of removal being received within the frame;

a first pair of channels extending along the base, adapted to receive the pair of faces of the at least one construction block that has a portion removed;

the first pair of channels comprising a pair of outer frame flanges located on either end of the base in generally perpendicular orientation to the base; and a first pair of inner frame flanges in parallel orientation to the pair of outer frame flanges extending upwardly from the base.

21. The structure as in claim 20 wherein the frame is a window frame.

22. The structure as in claim 20 wherein the frame is a door frame.

23. The structure as in claim 20 wherein the pane is sealed within the frame.

24. The structure as in claim 20 wherein the frame is rectangular-shaped.

25. The structure as in claim 20 wherein the frame is column-arched-shaped.

26. The structure as in claim 20 wherein the frame is circular-shaped.

a pair of outer frame flanges located on either end of the base in generally perpendicular orientation to the base; and a first pair of inner frame flanges, in parallel orientation to the pair of outer frame flanges, extending upwardly from the base, forming a pair of first channels between the first pair of inner frame flanges and the pair of outer frame flanges, each of the first channels receives one of the faces of one or more partially cut away construction blocks.

27. The structure as in claim 1 wherein each of the faces received within each of the first channels are siliconed within the first channels.

28. The structure as in claim 1 wherein each of the inner spacing flanges or each of the outer spacing flanges is received within each of the second channels are siliconed within the second channels.

29. The structure as in claim 1 wherein the frame is comprised of:

a second pair of channels, extending along the base, adapted to receive either the pair of inner spacing flanges of the outer spacing flanges of the at least one constructin block.

* * * * *